US007900424B2

(12) United States Patent
Bertuzzi et al.

(10) Patent No.: US 7,900,424 B2
(45) Date of Patent: Mar. 8, 2011

(54) METHOD AND WRAPPING UNIT FOR FOLDING A SHEET OF WRAPPING ABOUT A GROUP OF CIGARETTES

(75) Inventors: Ivanoe Bertuzzi, Casalecchio di Reno (IT); Luca Testoni, Castelmaggiore (IT); Antonio Vitali, Molinella (IT); Cristian Dakessian, Bologna (IT); Andrea Biondi, Bologna (IT)

(73) Assignee: G.D Societa'per Azioni, Bologna (IT)

( * ) Notice: Subject to any disclaimer, the term of this patent is extended or adjusted under 35 U.S.C. 154(b) by 2 days.

(21) Appl. No.: 12/369,235

(22) Filed: Feb. 11, 2009

(65) Prior Publication Data

US 2009/0199515 A1 Aug. 13, 2009

(30) Foreign Application Priority Data

Feb. 13, 2008 (IT) ..... BO2008A0094

(51) Int. Cl.
*B65B 19/24* (2006.01)

(52) U.S. Cl. ..... 53/466; 53/228

(58) Field of Classification Search ..... 53/439, 53/466, 530, 575, 228–234; *B65B 19/22, B65B 19/24*

See application file for complete search history.

(56) References Cited

U.S. PATENT DOCUMENTS

| | | | | | |
|---|---|---|---|---|---|
| 1,647,265 | A | * | 11/1927 | Bronander | 53/530 |
| 3,412,520 | A | | 11/1968 | Schmermund | |
| 3,996,728 | A | * | 12/1976 | Gentili | 53/389.3 |
| 4,241,564 | A | * | 12/1980 | Quarenghi | 53/575 |
| 4,711,065 | A | * | 12/1987 | Focke et al. | 53/234 |
| 5,133,173 | A | * | 7/1992 | Draghetti et al. | 53/466 |
| 6,035,612 | A | * | 3/2000 | Draghetti et al. | 53/466 |
| 6,658,819 | B2 | * | 12/2003 | Gamberini | 53/466 |

FOREIGN PATENT DOCUMENTS

| | | |
|---|---|---|
| EP | 1714878 | 10/2006 |
| EP | 1854724 | 11/2007 |
| FR | 748575 | 7/1933 |

OTHER PUBLICATIONS

European Search Report in EP 09 15 2615 dated May 5, 2009.

* cited by examiner

*Primary Examiner* — Stephen F Gerrity

(74) *Attorney, Agent, or Firm* — Marshall, Gerstein & Borun LLP

(57) ABSTRACT

A method and wrapping unit for producing a package containing a group of cigarettes, and which include: feeding the group of cigarettes along a path; feeding a sheet of wrapping perpendicularly to the path of the group of cigarettes; feeding a tubular spindle along the path of the group of cigarettes to intercept the sheet of wrapping and fold the sheet of wrapping into a U about the tubular spindle; and feeding the group of cigarettes through the tubular spindle to slide the sheet of wrapping off the tubular spindle and apply the U-folded sheet of wrapping to the group of cigarettes.

17 Claims, 14 Drawing Sheets

METHOD AND WRAPPING UNIT FOR FOLDING A SHEET OF WRAPPING ABOUT A GROUP OF CIGARETTES

CROSS-REFERENCE TO RELATED APPLICATIONS

This application claims the benefit of Italian patent application No. BO2008A 000094, filed Feb. 13, 2008.

TECHNICAL FIELD

The present invention relates to a method and wrapping unit for folding a sheet of wrapping about a group of cigarettes.

BACKGROUND ART

A packet of cigarettes normally comprises an inner package comprising a group of cigarettes wrapped in a sheet of inner wrapping; and an outer package enclosing the inner package, and which may be cup-shaped and comprise a sheet of outer wrapping folded about the inner package (soft packet of cigarettes), or may comprise a rigid, hinged-lid box formed by folding a rigid blank about the inner package (rigid packet of cigarettes).

Folding the sheet of inner wrapping about the group of cigarettes has been found to damage the ends of the cigarettes by producing local deformation (at both the filter-tipped end and the plain end) and/or tobacco fallout (i.e. loss of tobacco, obviously only from the plain tips at the opposite end to the filters). Damage by folding the sheet of inner wrapping about the group of cigarettes mostly applies to the cigarettes at the corners of the group, but is nevertheless evident in all the outer cigarettes, i.e. located along the fold lines of the sheet of inner wrapping. Moreover, the stiffness of the sheet of inner wrapping deforms the ends of the cigarettes, thus resulting in an inner package with rounded as opposed to square edges. This is particularly undesirable by producing an overall look of the exposed portion of the inner package that is not very popular with consumers, who tend to opt for inner packages with sharp, well pronounced edges.

Tobacco is highly sensitive to environment. That is, in contact with the atmosphere, its organic characteristics tend to vary alongside variations in humidity (by losing or absorbing too much moisture) or due to evaporation of the volatile substances with which the tobacco is impregnated (especially in the case of aromatic cigarettes treated with spices such as cloves). To preserve the tobacco, a rigid packet of cigarettes has been proposed, in which the inner package is airtight and comprises a sheet of airtight, heat-seal wrapping. Folding a sheet of airtight inner wrapping, however, is particularly damaging to the cigarettes, by being thicker (and therefore stiffer) than conventional sheets of foil inner wrapping.

DISCLOSURE OF THE INVENTION

It is an object of the present invention to provide a method and wrapping unit for folding a sheet of wrapping about a group of cigarettes, which method and wrapping unit are cheap and easy to implement, and provide for eliminating the above drawbacks.

According to the present invention, there are provided a method and wrapping unit for folding a sheet of wrapping about a group of cigarettes, as claimed in the attached Claims.

BRIEF DESCRIPTION OF THE DRAWINGS

A non-limiting embodiment of the present invention will be described by way of example with reference to the accompanying drawings, in which.

PREFERRED EMBODIMENTS OF THE INVENTION

Figure 1:
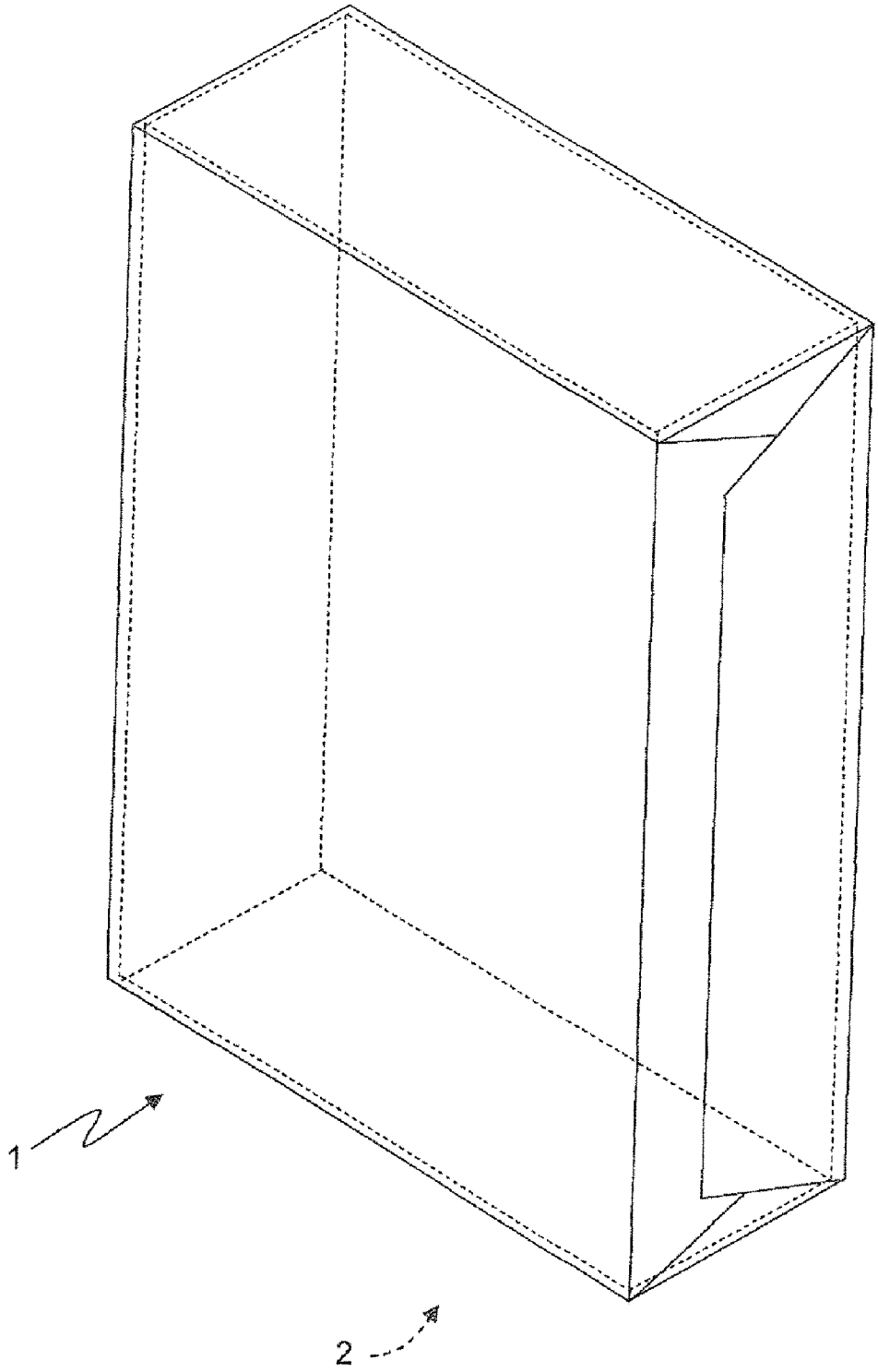
FIG. 1 shows a front view in perspective of a package of cigarettes.

Number 1 in FIG. 1 indicates as a whole a package of cigarettes enclosing a parallelepiped-shaped group 2 of cigarettes, and which can be inserted inside a known rigid, hinged-lid cigarette packet.

Package 1 is formed by folding a rectangular sheet 6 of wrapping (shown flat in FIG. 2) made of airtight, heat-seal plastic material directly about group 2 of cigarettes, so that it directly contacts the cigarettes. Once sheet 6 of wrapping is folded about group 2 of cigarettes to form package 1, the shape of package 1 is stabilized by heat sealing the superimposed portions of sheet 6 of wrapping. Number 10 in FIG. 2 indicates as a whole a packing machine for producing package 1 as described above.

Packing machine 10 comprises a group-forming unit (not shown in FIG. 2) for successively forming groups 2 of cigarettes; and a wrapping unit 12 (FIG. 2) on which a sheet 6 of wrapping is wrapped and heat sealed about each group 2 of cigarettes. It is important to bear in mind that packing machine 10 may comprise only the group-forming unit (not shown in FIG. 2) and wrapping unit 12; in which case, each package 1 described above is a finished marketable product. Alternatively, packing machine 10 may comprise a known further packing station to enclose each package 1 in an outer package, which may be cup-shaped and comprise a sheet of outer wrapping folded about package 1 (soft packet of cigarettes), or may comprise a rigid, hinged-lid box formed by folding a rigid blank about package 1 (rigid packet of cigarettes).

Groups 2 of cigarettes are transferred from the group-forming unit to wrapping unit 12 at a transfer station 24 defined between the group-forming unit (not shown) and wrapping unit 12. More specifically, transfer station 24 comprises a transfer device 25 in turn comprising two pushers 26 for transferring two groups 2 of cigarettes simultaneously from the group-forming unit to wrapping unit 12.

Wrapping unit 12 comprises two coaxial, superimposed input wheels 27, which receive and convey two groups 2 of cigarettes simultaneously. Each input wheel 27 is horizontal, rotates in steps about a common vertical axis 28 of rotation, and supports two peripheral pockets 29, each for housing a group 2 of cigarettes.

Wrapping unit 12 also comprises two coaxial, superimposed wrapping wheels 30, which simultaneously receive two groups 2 of cigarettes wrapped partly in respective sheets 6 of wrapping, each folded into a U. Each wrapping wheel 30 is horizontal, rotates in steps about a common vertical axis 31 of rotation, and supports two peripheral pockets 32, each for housing a group 2 of cigarettes wrapped partly in a respective sheet 6 of wrapping.

At a feed station 33 between the two input wheels 27 and the two wrapping wheels 30, two sheets 6 of wrapping are fed simultaneously along a vertical feed path to engage two groups 2 of cigarettes as they are transferred from the two input wheels 27 to the two wrapping wheels 30.

Each wrapping wheel 30 has known fixed and movable folding members (not shown) for folding the ends of each sheet 6 of wrapping about respective group 2 of cigarettes to form a package 1; and a sealing device 34 for heat sealing the superimposed end portions of each sheet 6 of wrapping.

Finally, wrapping unit 12 comprises two straight folding devices 35, each of which receives an unfinished package 1 from a respective wrapping wheel 30, and folds the sides of respective sheet 6 of wrapping about respective group 2 of cigarettes to complete package 1. Each folding device 35 preferably comprises fixed folding screws. Immediately downstream from each folding device 35, two sealing devices 36 heat seal the superimposed lateral portions of each sheet 6 of wrapping.

Figure 2:
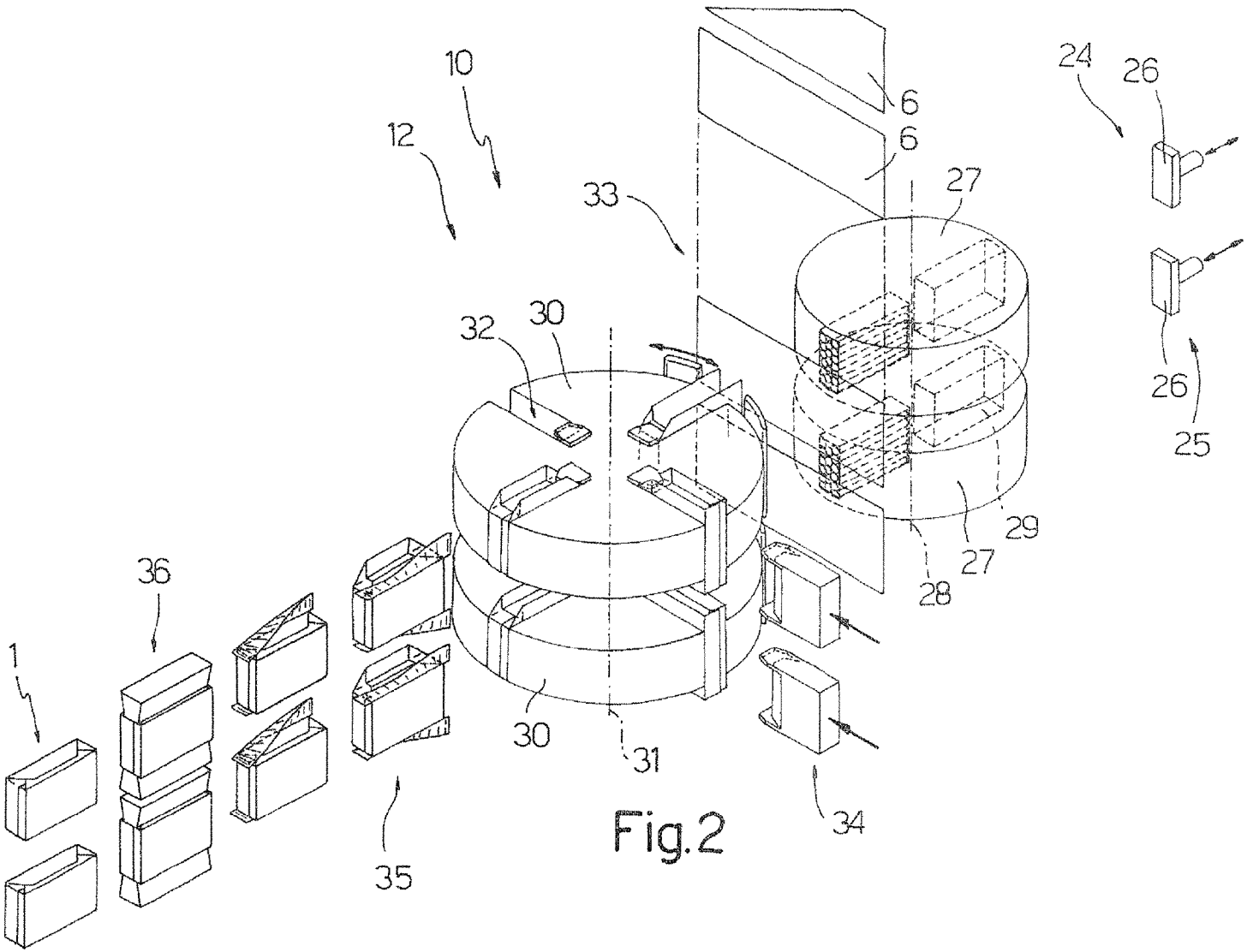
FIG. 2 shows a schematic view in perspective, with parts removed for clarity, of a cigarette packing machine wrapping unit for producing the FIG. 1 package of cigarettes and in accordance with the present invention.
Figure 3:
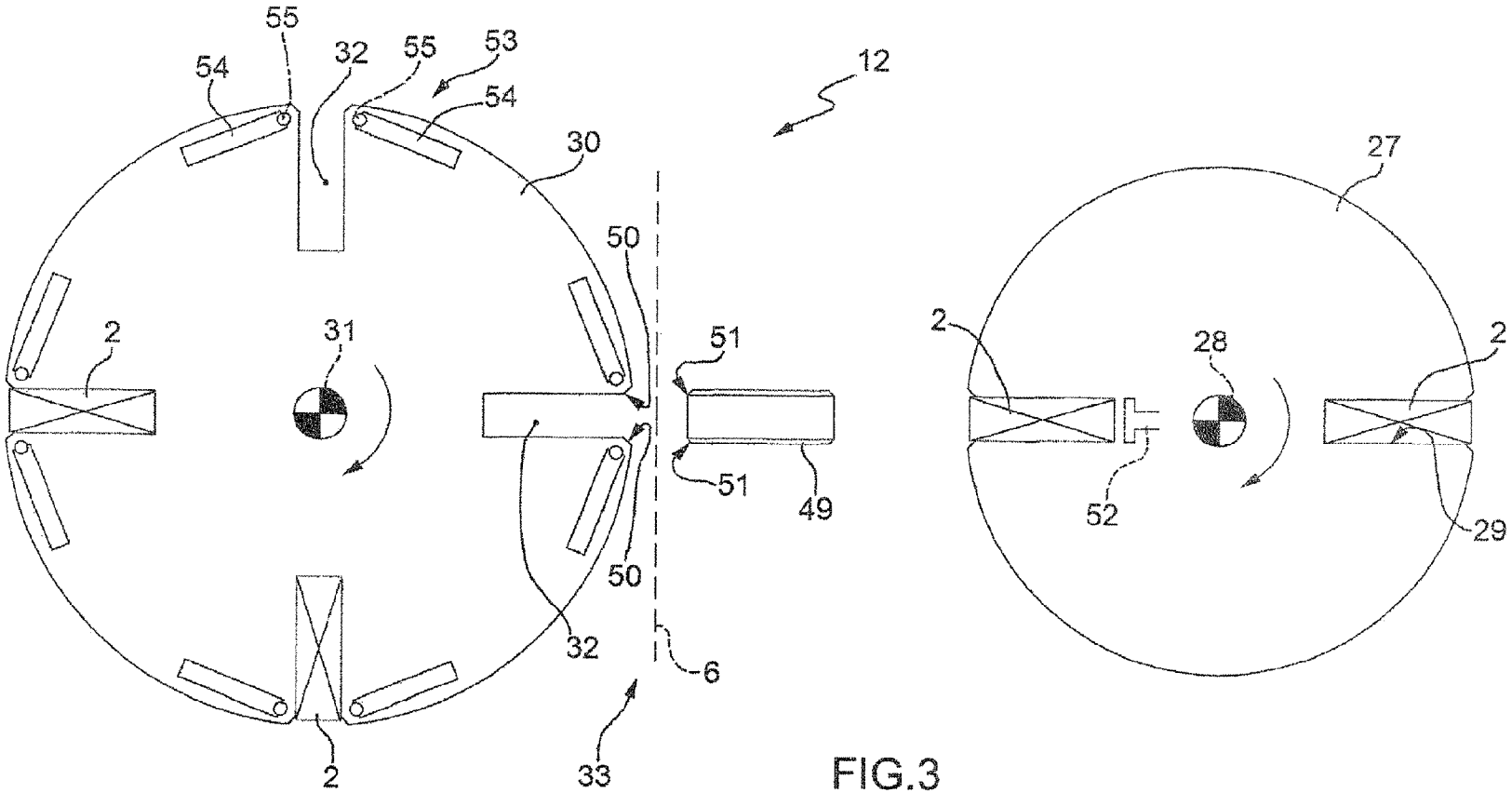
FIG. 3 shows a larger-scale plan view of a folding spindle of the FIG. 2 wrapping unit.

FIG. 3 shows a larger-scale plan view of feed station 33 of wrapping unit 12 in FIG. 2. As shown in FIG. 3, wrapping unit 12 comprises two tubular spindles 49 (only one shown in FIG. 3) located upstream from feed station 33, and through which are fed two respective groups 2 of cigarettes from the two input wheels 27. Each peripheral pocket 32 of each wrapping wheel 30 has an inlet/outlet opening defining a seat 50 for a convex outlet end 51 of respective tubular spindle 49; and each tubular spindle 49 is moved, by known actuating means (not shown) and back and forth in the travelling direction of groups 2 of cigarettes, to and from a position in which outlet end 51 engages the inlet/outlet opening of corresponding pocket 32. In other words, each tubular spindle 49 performs a reciprocating movement comprising a forward movement, in the travelling direction of group 2 of cigarettes, which causes tubular spindle 49 to intercept sheet 6 of wrapping (as described in detail below), and a return movement in the opposition direction to the travelling direction of group 2 of cigarettes.

The surface of outlet end 51 of each tubular spindle 49 that contacts sheets 6 of wrapping preferably has a number of suction holes (not shown) connected to a suction source not shown, and which serve to hold sheet 6 of wrapping in the correct position on outlet end 51 of tubular spindle 49 and prevent it from slipping with respect to tubular spindle 49.

It is important to note that outlet end 51 of each tubular spindle 49 is preferably truncated-cone-shaped, tapering in the travelling direction of group 2 of cigarettes, and the inlet end of seat 50 is also truncated-cone-shaped and complementary with the truncated-cone shape of outlet end 51 of tubular spindle 49.

A movable pusher 52, moving back and forth in the travelling direction of groups 2 of cigarettes, is connected to each input wheel 27 to expel a group 2 of cigarettes from a pocket 29 of input wheel 27 and through a respective tubular spindle 49 into a pocket 32 of respective wrapping wheel 30.

In a preferred embodiment, each pocket 32 of each wrapping wheel 30 has folding members 53 located on opposite sides of the inlet/outlet opening of pocket 32, and movable between a rest position (FIGS. 3, 4, 5, 7) in which folding members 53 are withdrawn inside wrapping wheel 30, and a work position (FIG. 6) in which folding members 53 project perpendicularly from wrapping wheel 30.

As shown in FIGS. 3-7, folding members 53 of each pocket 32 comprise two folders 54 hinged to wrapping wheel 30 and rotated about respective axes 55 of rotation, parallel to the axis 31 of rotation of wrapping wheel 30, by a cam actuating system not shown. In a different embodiment not shown, folding members 53 of each pocket 32 comprise two folders 54 fitted to wrapping wheel 30 and slid radially with respect to wrapping wheel 30 by a cam actuating system.

The way in which a group 2 of cigarettes and a respective sheet 6 of wrapping are fed into a pocket 32 of wrapping wheel 30 will now be described with reference to FIGS. 4-7.

Firstly, group 2 of cigarettes is expelled from pocket 29 of input wheel 27 into tubular spindle 49 by a pusher 52. As it is inserted inside tubular spindle 49, group 2 of cigarettes may be compressed laterally by the taper of the inner channel of tubular spindle 49. When inserting group 2 of cigarettes, tubular spindle 49 is stationary in a withdrawn position (FIG. 4), and defines, with pocket 32 of wrapping wheel 30 and at feed station 33, a gap through which a sheet 6 of wrapping is fed.

Tubular spindle 49 is then moved towards wrapping wheel 30, so that, before the leading end of group 2 of cigarettes reaches sheet 6 of wrapping, the outlet end 51 of tubular spindle 49 engages seat 50 of pocket 32 (FIG. 5) and folds sheet 6 of wrapping into a U. At this point, folding members 53 of pocket 32 are operated to move from the rest position (FIG. 5) to the work position (FIG. 6) to complete folding sheet 6 of wrapping into a U on tubular spindle 49.

Figures 4, 5, 6, 7:
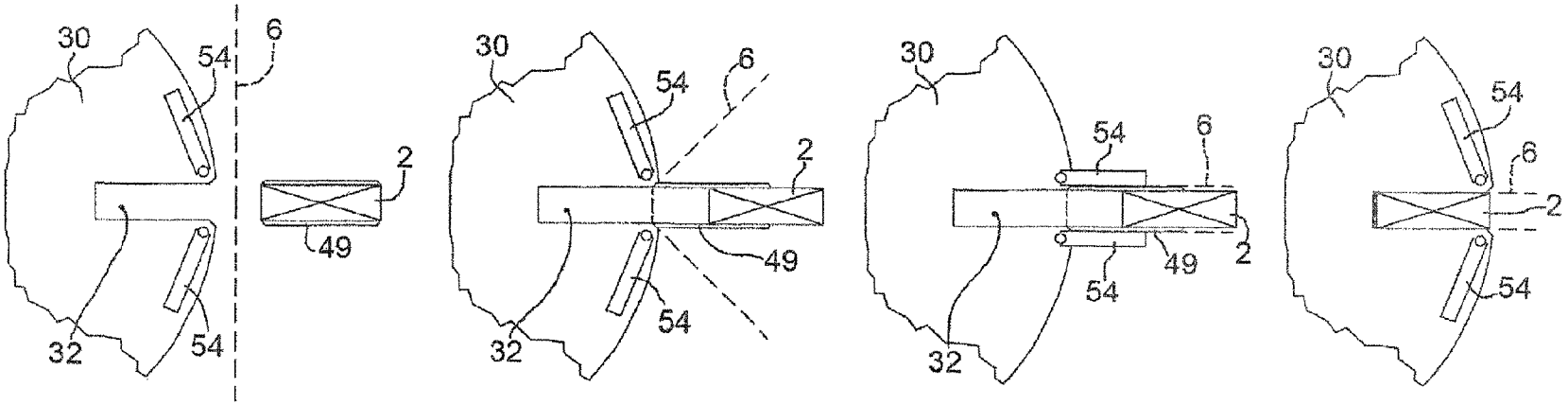
FIGS. 4-7 show a sequence of wrapping operations performed by the FIG. 3 folding spindle.
Figure 8:
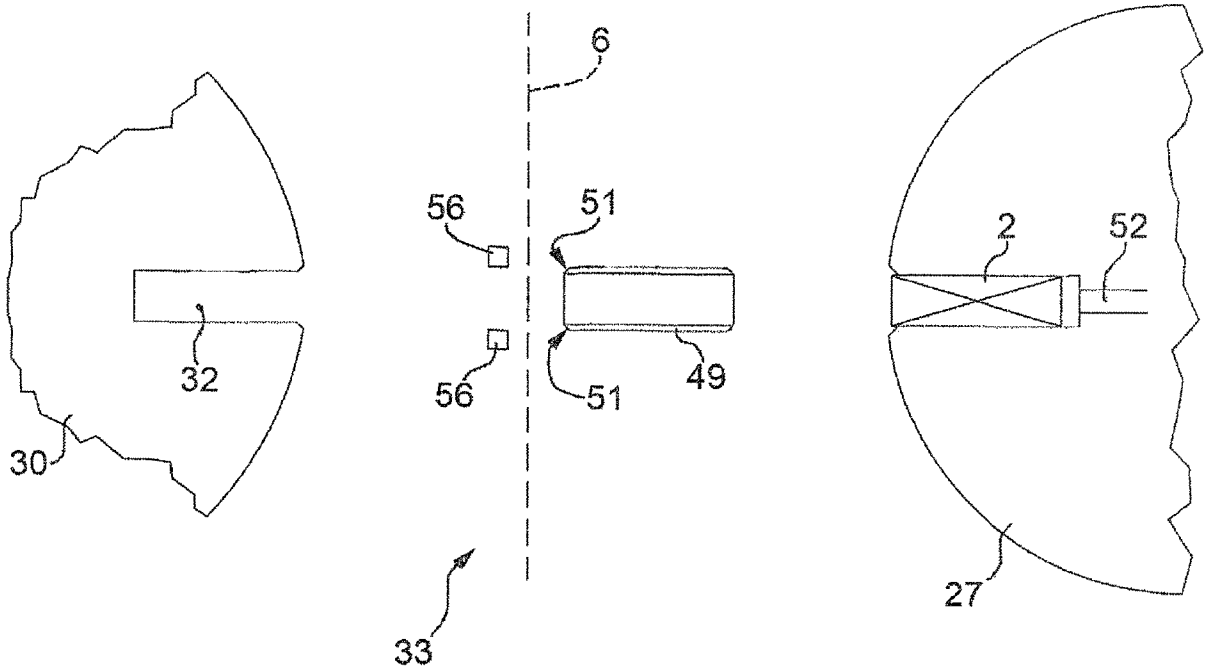
FIG. 8 shows a plan view of a different embodiment of the FIG. 3 folding spindle.

Finally, tubular spindle 49 returns to the withdrawn position in the opposite direction to the travelling direction of groups 2 of cigarettes, while group 2 of cigarettes is kept moving by pusher 52 and inserted inside pocket 32 together with sheet 6 of wrapping, which slides off tubular spindle 49 and wraps onto group 2 of cigarettes (FIG. 7).

Each sheet 6 of wrapping is therefore folded into a U, not by the axial thrust exerted on it by the cigarettes in group 2, but by the thrust exerted by tubular spindle 49, which acts as a folder. When folding sheet 6 of wrapping into a U, the cigarettes in group 2 therefore undergo absolutely no axial stress and, hence, no deformation.

In other words, group 2 of cigarettes is fed along one path, while sheet 6 of wrapping is fed perpendicularly to the path of group 2 of cigarettes. At this point, a tubular spindle 49 is fed along the path of group 2 of cigarettes to intercept and fold sheet 6 of wrapping into a U about tubular spindle 49; and, finally, group 2 of cigarettes is fed through tubular spindle 49 (which by then is moving in the opposite direction) to slide the U-folded sheet 6 of wrapping off tubular spindle 49 and onto group 2 of cigarettes.

In the FIG. 3-7 embodiment, each tubular spindle 49 is of limited travel, and folds sheet 6 of wrapping into a U against seat 50 of a pocket 32 of wrapping wheel 30.

In a variation shown in FIGS. 8-11, each tubular spindle 49 has a longer travel, and folds sheet 6 of wrapping into a U against fixed folders 56.

The way in which a group 2 of cigarettes and a respective sheet 6 of wrapping are fed into a pocket 32 of wrapping wheel 30 will now be described with reference to FIGS. 8-11.

Figure 9:
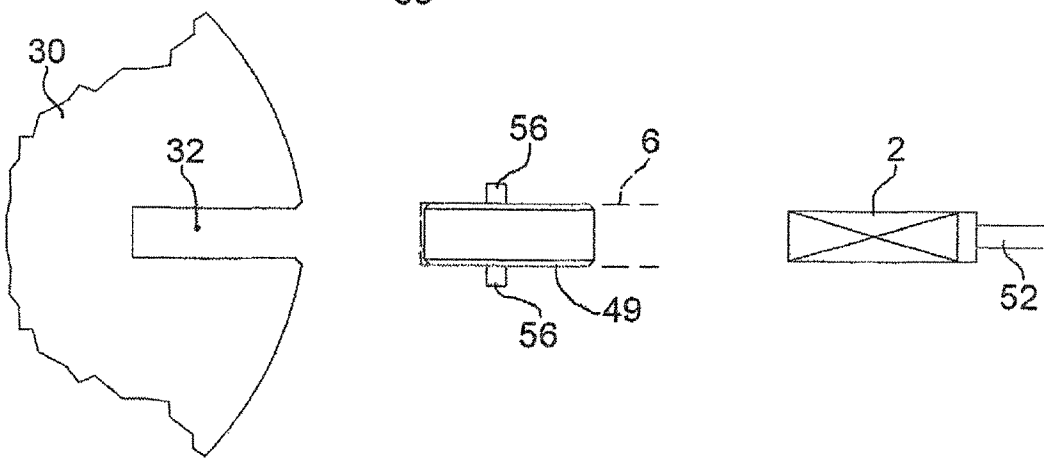
FIGS. 9-11 show a sequence of wrapping operations performed by the FIG. 8 folding spindle.
Figure 10:
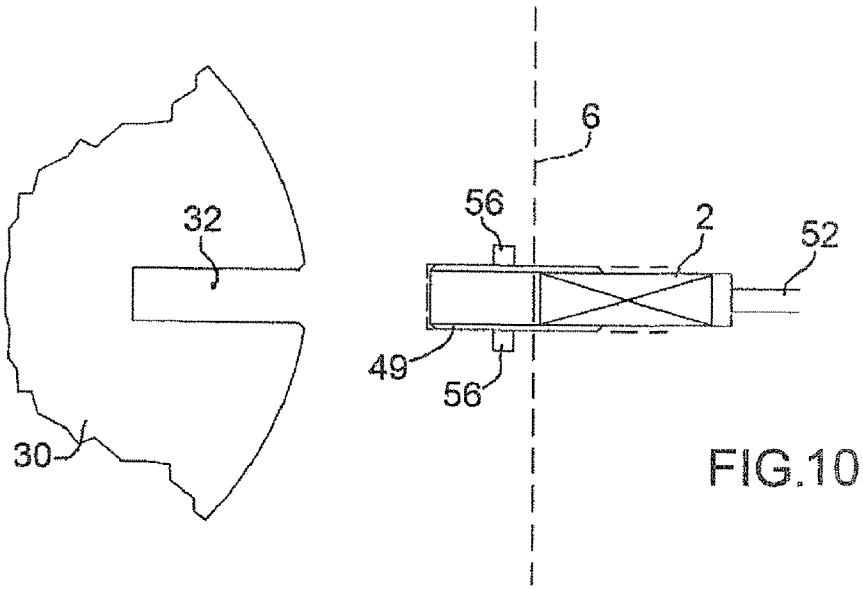

To begin with, tubular spindle 49 is stationary in a withdrawn position (FIG. 8), and defines, with pocket 32 of wrapping wheel 30 and at feed station 33, a gap through which a sheet 6 of wrapping is fed. Tubular spindle 49 is then moved towards wrapping wheel 30, so that the outlet end 51 of tubular spindle 49 engages and folds sheet 6 of wrapping into a U against fixed folders 56 (FIG. 9). At this point (FIG. 10), group 2 of cigarettes is expelled from pocket 29 of input wheel 27 into tubular spindle 49 by pusher 52. As it is inserted inside tubular spindle 49, group 2 of cigarettes may be compressed laterally by the taper of the inner channel of tubular spindle 49.

Figure 11:
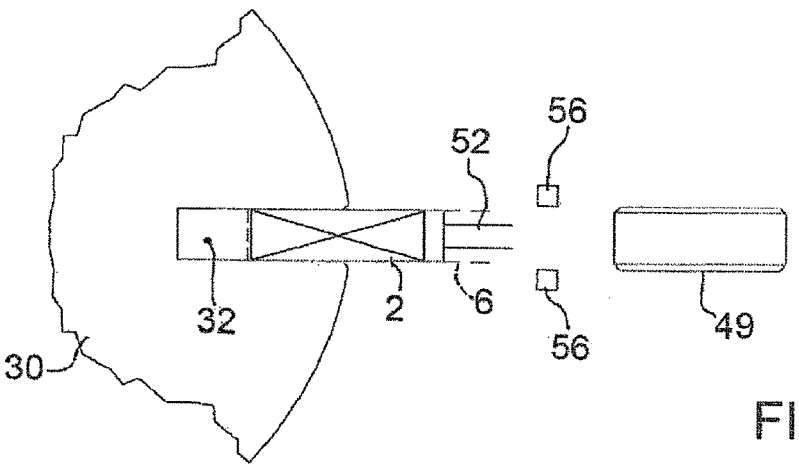
Figure 12:
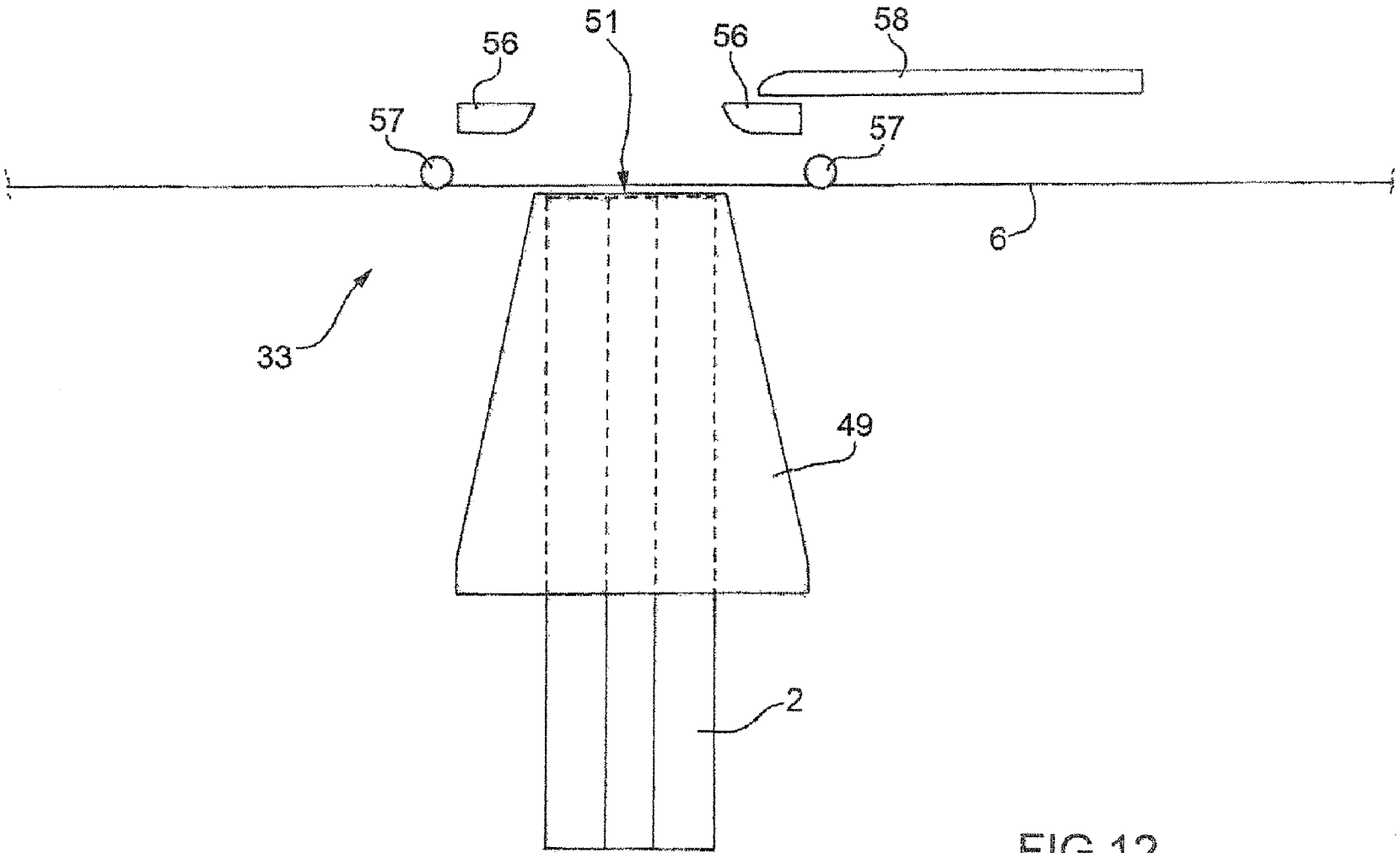
FIG. 12 shows a plan view of a further embodiment of the FIG. 8 folding spindle.

Finally, tubular spindle 49 returns to the withdrawn position in the opposite direction to the travelling direction of groups 2 of cigarettes, while group 2 of cigarettes is kept moving by pusher 52 and fed completely through tubular spindle 49 into pocket 32 together with sheet 6 of wrapping, which slides off tubular spindle 49 and wraps onto group 2 of cigarettes (FIG. 11).

In a variation not shown, group 2 of cigarettes is first expelled from pocket 29 of input wheel 27 into tubular spindle 49 by a pusher 52. When inserting group 2 of cigarettes inside tubular spindle 49, tubular spindle 49 is stationary in a withdrawn position, and defines, with pocket 32 of wrapping wheel 30 and at feed station 33, a gap through which a sheet 6 of wrapping is fed.

Next, tubular spindle 49, together with the group 2 of cigarettes inside it, is moved towards wrapping wheel 30, so that the outlet end 51 of tubular spindle 49 engages and folds sheet 6 of wrapping into a U against fixed folders 56

Finally, tubular spindle 49 returns to the withdrawn position in the opposite direction to the travelling direction of groups 2 of cigarettes, while group 2 of cigarettes is kept moving by pusher 52 and fed completely through tubular spindle 49 into pocket 32 together with sheet 6 of wrapping, which slides off tubular spindle 49 and wraps onto group 2 of cigarettes.

In the FIG. 8-11 embodiment, folders 56 are fixed, and each spindle 49 travels a long way to complete folding sheet 6 of wrapping into a U about spindle 49. The FIG. 12-18 embodiment comprises two further movable folders 57, which move in the opposite direction to each spindle 49 to complete folding sheet 6 of wrapping into a U about spindle 49. In this case, each spindle 49 travels a short distance to fold sheet 6 of wrapping against fixed folders 56, and sheet 6 of wrapping is folded into a U about spindle 49 mostly by the action of movable folders 57.

In the FIG. 12-18 variation, each spindle 49 is truncated-cone-shaped, tapering towards fixed folders 56. More specifically, the outlet end 51 of each tubular spindle 49 is truncated-cone-shaped, and tapers in the travelling direction of group 2 of cigarettes; and an inlet end of fixed folders 56 is truncated-cone-shaped and complementary to the truncated-cone shape of the outlet end of tubular spindle 49.

The way in which a group 2 of cigarettes and a respective sheet 6 of wrapping are fed into a pocket 32 of wrapping wheel 30 will now be described with reference to FIGS. 12-18.

Firstly, group 2 of cigarettes is expelled from pocket 29 of input wheel 27 (not shown in FIGS. 12-18) into tubular spindle 49 by a pusher 52. As it is inserted inside tubular spindle 49, group 2 of cigarettes may be compressed laterally by the taper of the inner channel of tubular spindle 49. When inserting group 2 of cigarettes, tubular spindle 49 is stationary in a withdrawn position (FIG. 12), and defines, with pocket 32 of wrapping wheel 30 (not shown in FIGS. 12-18) and at feed station 33, a gap through which a sheet 6 of wrapping is fed.

Figure 13:
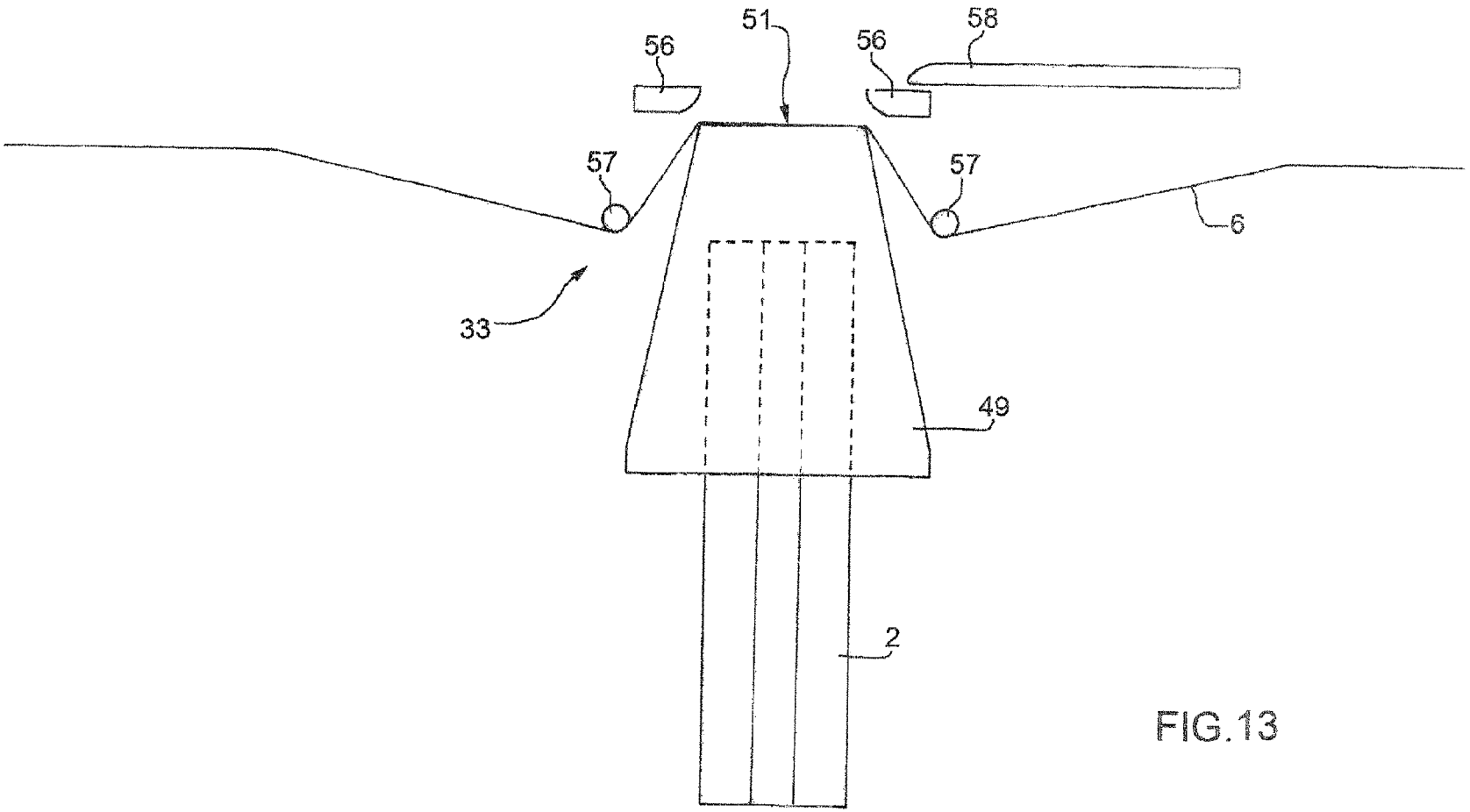
FIGS. 13-16 show a sequence of wrapping operations performed by the FIG. 12 folding spindle.
Figure 14:
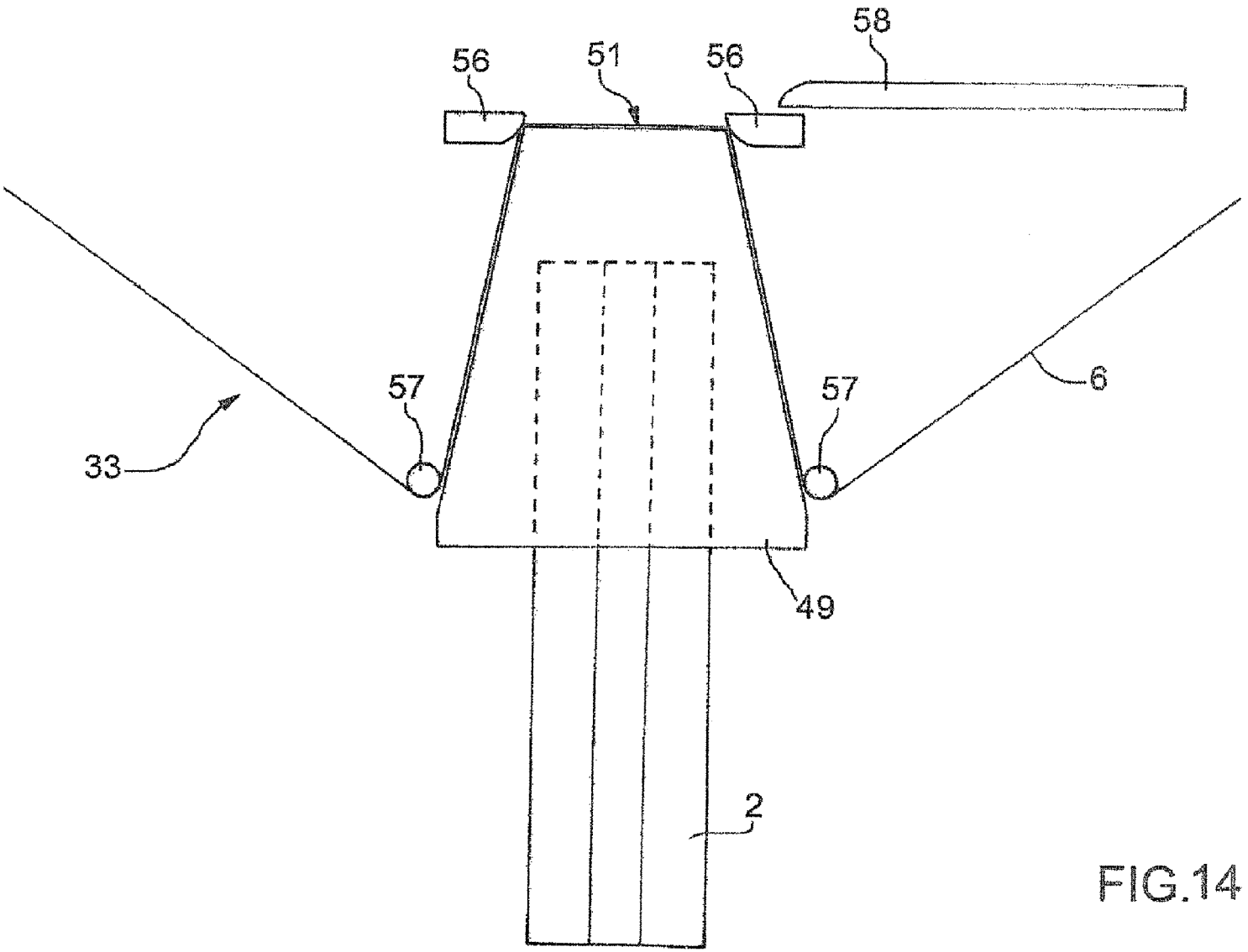

Next, tubular spindle 49 is moved, together with group 2 of cigarettes, towards wrapping wheel 30, so that outlet end 51 of tubular spindle 49 engages and folds sheet 6 of wrapping into a U against fixed folders 56 (FIG. 14). At the same time (or even slightly before or after), movable folders 57 move in the opposite direction to each spindle 49 to complete folding sheet 6 of wrapping into a U about spindle 49 (FIGS. 13 and 14).

Figure 15:
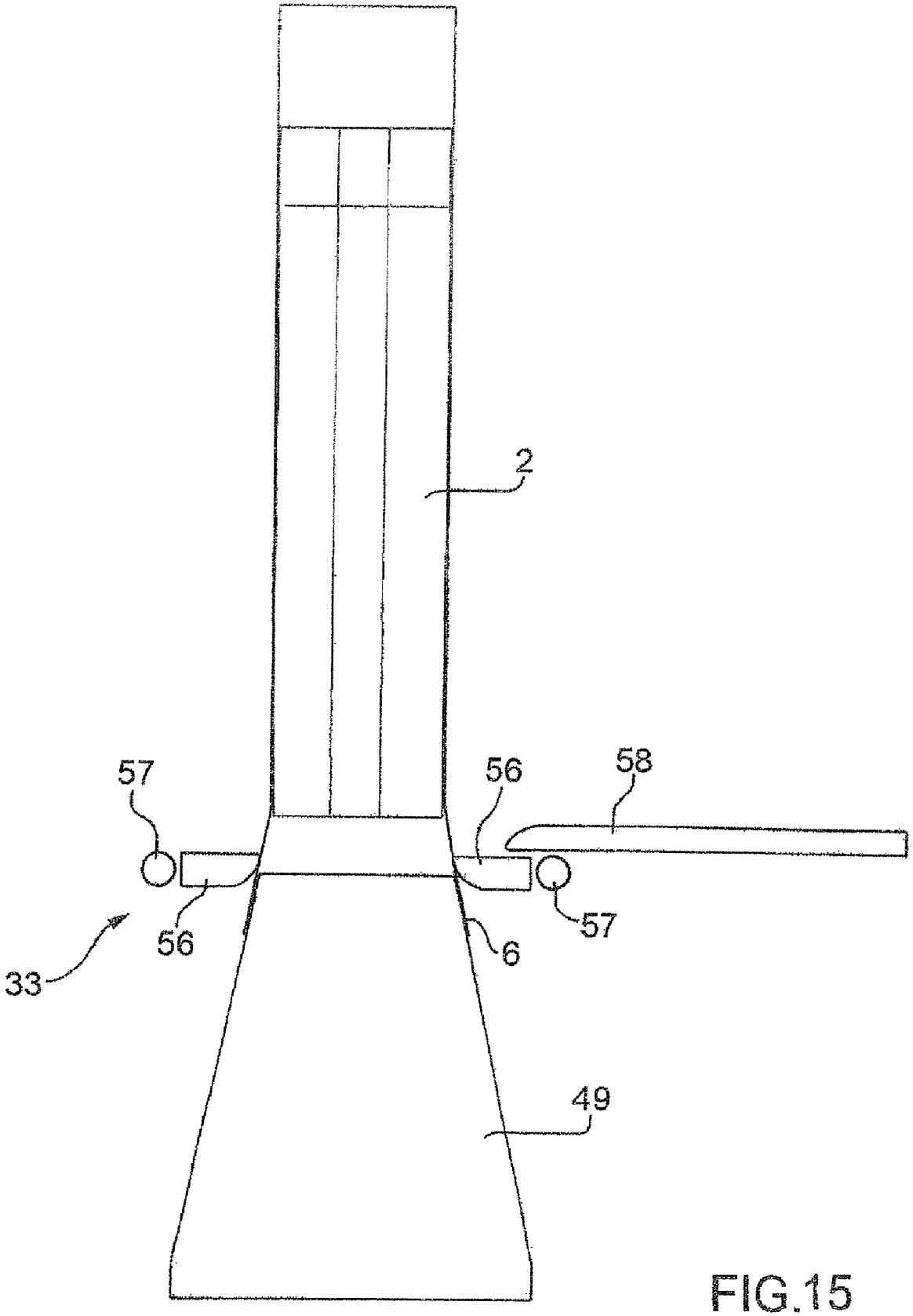
Figure 16:
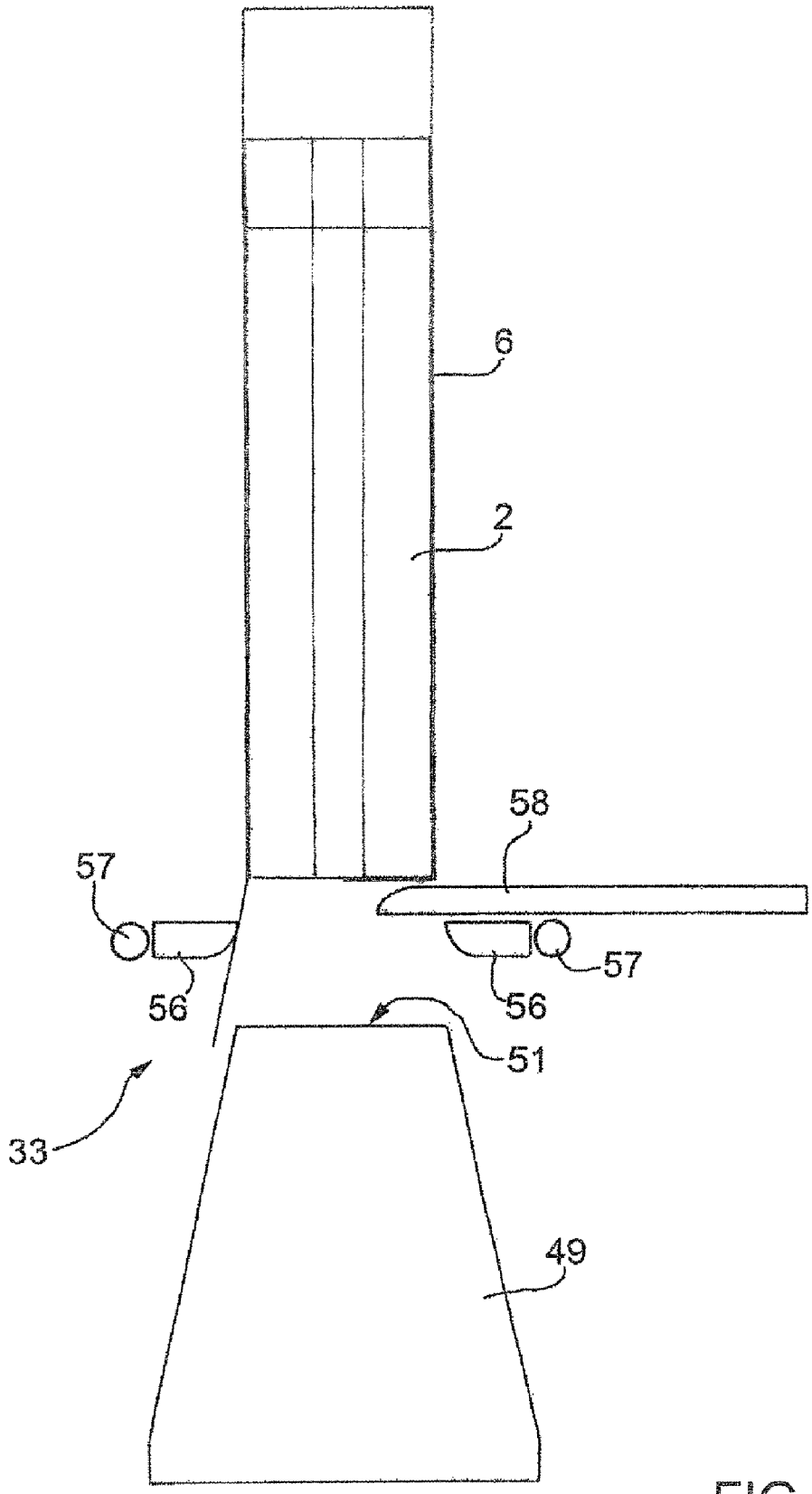
Figure 17:
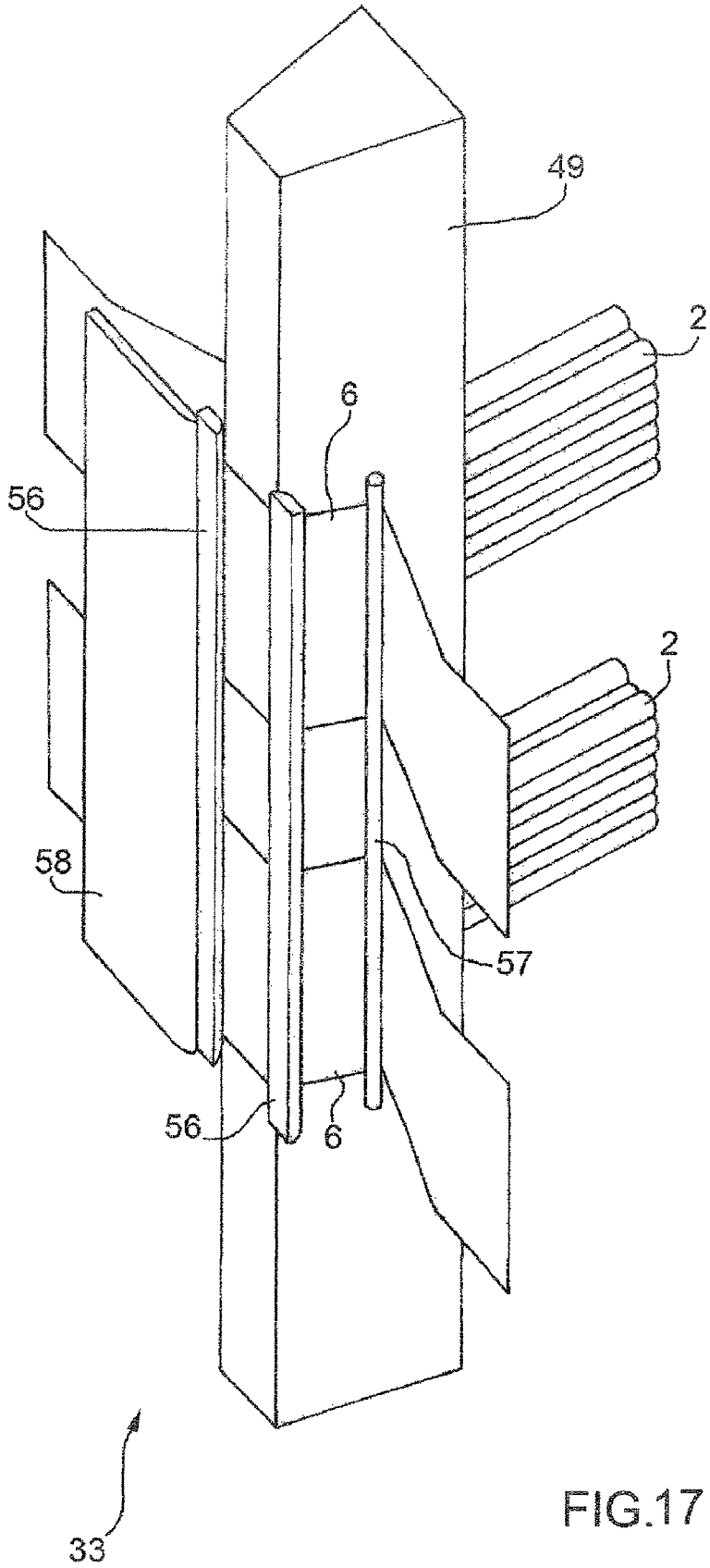
FIGS. 17 and 18 show two views in perspective of the FIG. 12 folding spindle.
Figure 18:
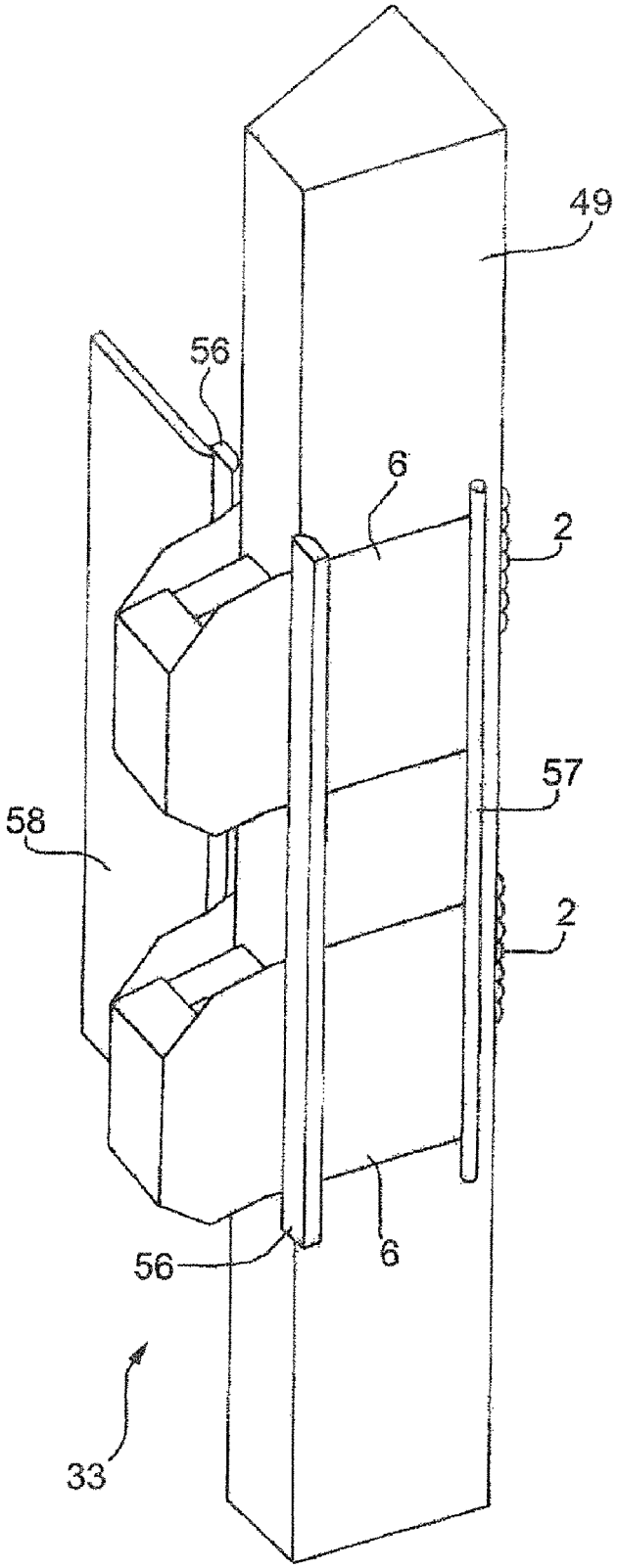

Finally, group 2 of cigarettes is kept moving by pusher 52 and fed completely through spindle 49 into pocket 32 (not shown in FIGS. 12-18) together with sheet 6 of wrapping, which slides off tubular spindle 49 and wraps onto group 2 of cigarettes (FIG. 15). Once group 2 of cigarettes is expelled completely from spindle 49 (FIG. 15), tubular spindle 49 returns to the withdrawn position in the opposite direction to the travelling direction of groups 2 of cigarettes, and, at the same time, a folder 58 folds one of the two flaps of the U-folded sheet 6 of wrapping onto group 2 of cigarettes (FIG. 16).

Figure 19:
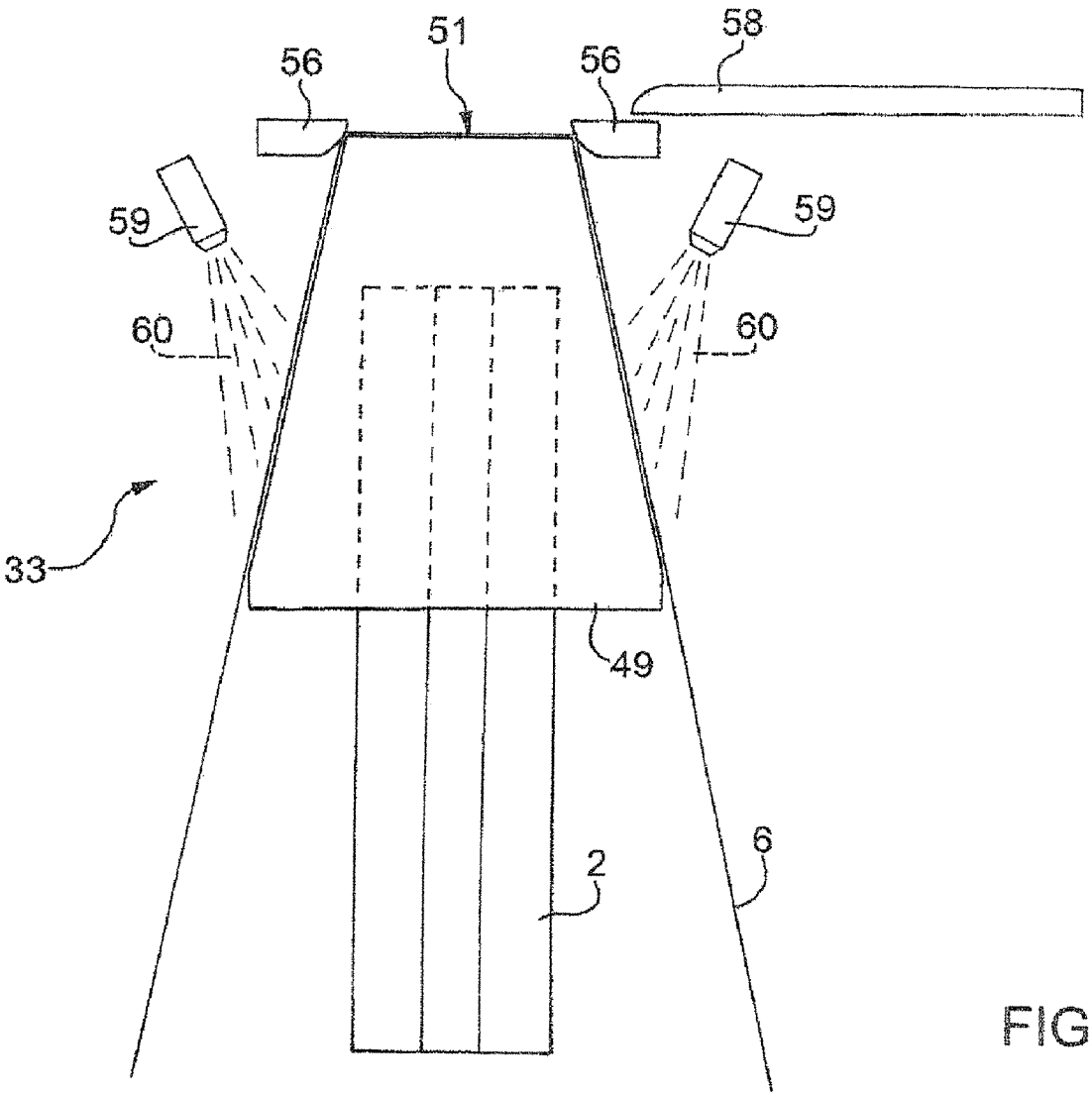
FIG. 19 shows a variation of the FIG. 12 folding spindle.

FIG. 19 shows a variation of the FIG. 12-18 embodiment, in which movable folders 57 are replaced by two nozzles 59 for directing compressed-air jets 60 onto the wings of sheet 6 of wrapping on opposite sides of tubular spindle 49 to complete folding sheet 6 of wrapping into a U about spindle 49. The FIG. 19 variation is simpler in design by substituting a fixed component (nozzles 59) for a movable component (movable folders 57) moving independently of the other components.

At feed station 33, sheet 6 of wrapping is engaged, not by group 2 of cigarettes, but by corresponding spindle 49, and is therefore folded into a U by spindle 49, as opposed to group 2 of cigarettes, engaging it. Only after spindle 49 has pre-folded sheet 6 of wrapping is group 2 of cigarettes inserted inside the already-folded sheet 6 of wrapping. By so doing, both ends of the cigarettes in group 2 undergo absolutely no mechanical stress when first folding sheet 6 of wrapping, thus preventing undesired deformation of both the filters and the tips of the cigarettes. Moreover, by virtue of spindles 49 cooperating with seats 50 or fixed folders 56, the edges of inner package 1 are sharp and well defined, thus imparting an attractive square shape to the exposed top portion of inner package 1.

The invention claimed is:

1. A method of producing a package (1) containing a group (2) of cigarettes; the method comprising the steps of:

feeding the group (2) of cigarettes along a path;

feeding a sheet (6) of wrapping perpendicularly to the path of the group (2) of cigarettes;

feeding a tubular spindle (49) along the path of the group (2) of cigarettes to intercept the sheet (6) of wrapping and fold the sheet (6) of wrapping into a U about the tubular spindle (49);

feeding the group (2) of cigarettes through the tubular spindle (49) to slide the sheet (6) of wrapping off the tubular spindle (49) and apply the U-folded sheet (6) of wrapping to the group (2) of cigarettes; and moving a movable folding member with respect to the tubular spindle (49) to complete folding the sheet (6) of wrapping into a U on the tubular spindle (49).

2. A method as claimed in claim 1, wherein the movable folding member comprises two folders (54) located on opposite sides of the tubular spindle (49) and hinged to rotate about respective axes (55) of rotation.

3. A method as claimed in claim 1, wherein the movable folding member comprises two folders (57) located on opposite sides of the tubular spindle (49) and which slide in the opposite direction to the travelling direction of the group (2) of cigarettes.

4. A method as claimed in claim 1, and comprising the further step of directing compressed-air jets (60) onto wings of the sheet (6) of wrapping on opposite sides of the tubular spindle (49), to complete folding the sheet (6) of wrapping into a U on the tubular spindle (49).

5. A method as claimed in claim 1, and comprising the further step of feeding the tubular spindle (49) between two fixed folders (56) to complete folding the sheet (6) of wrapping into a U on the tubular spindle (49).

6. A method as claimed in claim 1, and comprising the further step of imparting to the tubular spindle (49) a reciprocating movement comprising a forward movement, in the travelling direction of the group (2) of cigarettes, which causes the tubular spindle (49) to intercept the sheet (6) of wrapping, and a return movement in the opposition direction to the travelling direction of the group (2) of cigarettes.

7. A method as claimed in claim 1, wherein the tubular spindle (49) cooperates with a fixed folder (50; 56) to fold the sheet (6) of wrapping into a U.

8. A method as claimed in claim 7, wherein an outlet end (51) of the tubular spindle (49) is truncated-cone-shaped, tapering in the travelling direction of the group (2) of cigarettes; and an inlet end of the fixed folder (50; 56) is truncated-cone-shaped and complementary with the truncated-cone shape of the outlet end (51) of the tubular spindle (49).

9. A method as claimed in claim 1, and comprising the further step of subjecting the group (2) of cigarettes to lateral compression produced by tapering of an inner channel of the tubular spindle (49).

10. A wrapping unit for producing a package (1) containing a group (2) of cigarettes; the wrapping unit (12) comprising:

a feed device (52) for feeding the group (2) of cigarettes along a path;

a feed station (33) for feeding a sheet (6) of wrapping perpendicularly to the path of the group (2) of cigarettes;

a tubular spindle (49) which is fed along the path of the group (2) of cigarettes to intercept the sheet (6) of wrapping and fold the sheet (6) of wrapping into a U about the tubular spindle (49); wherein the feed device (52) feeds the group (2) of cigarettes through the tubular spindle (49) to slide the sheet (6) of wrapping off the tubular spindle (49) and apply the U-folded sheet (6) of wrapping to the group (2) of cigarettes; and a movable folding member to complete folding the sheet (6) of wrapping into a U on the tubular spindle (49).

11. A wrapping unit as claimed in claim 10, and comprising nozzles (59) located on opposite sides of the tubular spindle (49) to direct compressed-air jets (60) onto wings of the sheet (6) of wrapping on opposite sides of the tubular spindle (49), to complete folding the sheet (6) of wrapping into a U on the tubular spindle (49).

12. A wrapping unit as claimed in claim 10, and comprising two fixed folders (56) located on opposite sides of the tubular spindle (49), and between which the tubular spindle (49) is fed to complete folding the sheet (6) of wrapping into a U.

13. A wrapping unit as claimed in claim 10, wherein the tubular spindle (49) is moved in a reciprocating movement comprising a forward movement, in the travelling direction of the group (2) of cigarettes, which causes the tubular spindle (49) to intercept the sheet (6) of wrapping, and a return movement in the opposition direction to the travelling direction of the group (2) of cigarettes.

14. A wrapping unit as claimed in claim 10, wherein a surface of the tubular spindle (49) that comes into contact with the sheets (6) of wrapping has a number of holes connected to a suction source.

15. A method of producing a package (1) containing a group (2) of cigarettes; the method comprising the steps of:

feeding the group (2) of cigarettes along a path;

feeding a sheet (6) of wrapping perpendicularly to the path of the group (2) of cigarettes;

feeding a tubular spindle (49) along the path of the group (2) of cigarettes to intercept the sheet (6) of wrapping and fold the sheet (6) of wrapping into a U about the tubular spindle (49);

feeding the group (2) of cigarettes through the tubular spindle (49) to slide the sheet (6) of wrapping off the tubular spindle (49) and apply the U-folded sheet (6) of wrapping to the group (2) of cigarettes; and feeding the tubular spindle (49) between two fixed folders (56) to complete folding the sheet (6) of wrapping into a U on the tubular spindle (49).

16. A wrapping unit for producing a package (1) containing a group (2) of cigarettes; the wrapping unit (12) comprising:

a feed device (52) for feeding the group (2) of cigarettes along a path;

a feed station (33) for feeding a sheet (6) of wrapping perpendicularly to the path of the group (2) of cigarettes;

a tubular spindle (49) which is fed along the path of the group (2) of cigarettes to intercept the sheet (6) of wrapping and fold the sheet (6) of wrapping into a U about the tubular spindle (49); wherein the feed device (52) feeds the group (2) of cigarettes through the tubular spindle (49) to slide the sheet (6) of wrapping off the tubular spindle (49) and apply the U-folded sheet (6) of wrapping to the group (2) of cigarettes; and two fixed folders (56) located on opposite sides of the tubular spindle (49), and between which the tubular spindle (49) is fed to complete folding the sheet (6) of wrapping into a U.

17. A wrapping unit for producing a package (1) containing a group (2) of cigarettes; the wrapping unit (12) comprising:

a feed device (52) for feeding the group (2) of cigarettes along a path;

a feed station (33) for feeding a sheet (6) of wrapping perpendicularly to the path of the group (2) of cigarettes; and a tubular spindle (49) which is fed along the path of the group (2) of cigarettes to intercept the sheet (6) of wrapping and fold the sheet (6) of wrapping into a U about the tubular spindle (49); wherein the feed device (52) feeds the group (2) of cigarettes through the tubular spindle (49) to slide the sheet (6) of wrapping off the tubular spindle (49) and apply the U-folded sheet (6) of wrapping to the group (2) of cigarettes; and wherein a surface of the tubular spindle (49) that comes into contact with the sheets (6) of wrapping has a number of holes connected to a suction source.

* * * * *